US008263845B2

(12) United States Patent
McDonald

(10) Patent No.: US 8,263,845 B2
(45) Date of Patent: Sep. 11, 2012

(54) FINGER-MOUNTED STRIKING DEVICES FOR ACTIVATING MUSICAL INSTRUMENT STRINGS

(76) Inventor: Thomas E McDonald, Parkesburg, PA (US)

( * ) Notice: Subject to any disclaimer, the term of this patent is extended or adjusted under 35 U.S.C. 154(b) by 0 days.

(21) Appl. No.: 13/316,756

(22) Filed: Dec. 12, 2011

(65) Prior Publication Data

US 2012/0079703 A1 Apr. 5, 2012

Related U.S. Application Data

(63) Continuation-in-part of application No. 12/887,603, filed on Sep. 22, 2010.

(51) Int. Cl.
*G10D 3/00* (2006.01)

(52) U.S. Cl. ..... 84/315

(58) Field of Classification Search ..... 84/315–322
See application file for complete search history.

(56) References Cited

U.S. PATENT DOCUMENTS 7,829,774 B2 * 11/2010 Moncrief ..... 84/315
8,097,798 B2 * 1/2012 McDonald ..... 84/315

* cited by examiner

*Primary Examiner* — Kimberly Lockett
(74) *Attorney, Agent, or Firm* — Joseph F. Aceto, Esq.

(57) ABSTRACT

The finger-mounted striking devices described herein are for use on stringed musical instruments, in particular for but not limited to electric or acoustic bass instruments. The paired devices consist of elongated cylindrical wooden shafts of differing length. The offset in length allows the striking tips to be effectively even when worn as intended on the index and middle fingers. The striking tip of each shaft contains a permanently embedded weight to accelerate the transfer of finger movement to the shaft tip. The mechanism for attaching the elongated shaft to each finger is an adjustable metal ring permanently attached to the shaft end opposite the striking tip. An upward-sloped fingertip rest is provided forward of the ring. The entire body of each elongated shaft and the integral metal ring are encased in an elastomeric coating that prevents scratching of the instrument surface during use by the devices and seals the metal ring against corrosion from moisture. Additional layers of elastomer coating are added to the sinking tip to eliminate impact damage to the outer windings of instrument strings.

10 Claims, 3 Drawing Sheets

FINGER-MOUNTED STRIKING DEVICES FOR ACTIVATING MUSICAL INSTRUMENT STRINGS

CROSS-REFERENCE

This application is a continuation-in-part of U.S. patent application Ser. No. 12/887,803, filed Sep. 22, 2010, which the benefit of priority of U.S. Provisional Application No. 61/245,299, filed Sep. 24, 2009, which is incorporated by reference in the present specification as if set forth herein in full.

FIELD OF THE INVENTION

This invention relates to the field of stringed musical instruments, and more specifically to finger-mounted devices used to rhythmically tap or strike bass instrument strings so as to produce musical notes with unique percussive undertones.

BACKGROUND OF THE INVENTION

Electric and acoustic bass instruments including the bass guitar, the upright double bass and cello provide the rhythmic foundation to musical compositions. Typical of the many types of popular musical genres that can foe played on string instruments are rock, funk, soul, salsa, hip-hop, Cajun zydeco, classical and country.

Musicians performing musical compositions on acoustic or amplified bass instruments employ multiple methods of string activation. The traditional methods for activation of single or multiple bass strings to produce musical notes include: the combined use of fingers and thumb; use of a single finger-gripped plectrum commonly referred to as a pick; use of finger or thumb mounted picks; and use of a strung bow. More recent variations to traditional bass string activation methods include quickly plucking or snapping a string above the freeboard to produce notes with a popping undertone, and the use of a glancing thumb strike on a string to produce notes with a slapping undertone.

In a single performance a musician may employ any or all of the traditional and non-traditional methods of string activation. Common to ail of the methods is a constant, repetitive movement of the muscles, ligaments and joints comprising the human hand including the fingers, palm, wrist, forearm and elbow. A rehearsal session or live performance lasting several hours or more can lead to fatigue with loss of mobility in the fingers, palm and wrist of the string activating hand. Excessive overuse can eventually cause injury to the ligaments, joints and nerves of the hand, fingers, forearm and elbow.

OBJECTIVE OF THE INVENTION

One embodiment of the present invention provides for elastomer-coated, finger-mounted string activation devices for rhythmically tapping or striking bass instrument strings when positioned above the distal interphalangeal joint on the index and middle finger of a musician.

Another embodiment of this invention is to provide a method and means to instantly transmit a musician's finger movement to the striking tip of each shaft by use of a weight embedded in the tip that also provides a percussive undertone to each resultant note. Through controlled finger movement a musician can continuously alter the pressure and force of each delivered tap or strike to obtain unique and novel stylization of notes within a composition.

It is a further embodiment of the present invention to provide string activation devices that mount to the index and middle fingers by means of an adjustable metal ring that is coated with an elastomer that effectively prevents slippage of the device from the finger during use and further seals the metal surface of the ring against corrosion from moisture.

It is the further embodiment of the present invention to provide paired devices that can be worn by a musician on the right or left hand to provide a method for reducing the stress typically imparted to the ligaments, joints and nerves of the string activating hand.

It is the further embodiment of the present invention to provide for the manufacture of elastomer-coated, finger-mounted string activation devices described in the present invention which are used in the rhythmic tapping or striking of instrument strings such as, but not limited to, a bass instrument.

SUMMARY OF THE INVENTION

The present invention provides a pair of string activation devices that are easily secured above the distal interphalangeal joint of the index and middle fingers on the right or left hand and are used to rhythmically tap or strike bass instrument strings to produce notes with a percussive undertone. The interior foundation of each device in a pair consists of an elongated cylindrical wooden shaft of differing length. The offset in length allows the striking tips to be effectively even when worn as intended on the index and middle fingers. The striking tip of each shaft contains a permanently embedded weight to accelerate the transfer of finger movement to the shaft tip. The mechanism for attaching the elongated shaft to each finger is an adjustable metal ring permanently attached to the shaft end opposite the striking tip. An upward-sloped fingertip rest is provided forward of the ring. The entire body of each elongated shaft and the integral metal ring are encased in an elastomeric coating that prevents scratching of the instrument surface by the devices and seals the metal ring against corrosion from moisture. Additional layers of elastomer coating are added at the striking tips to eliminate impact damage to the outer windings of instrument strings. A minimum of five (5) layers of elastomeric coating has been determined to effectively coat the striking tips.

Additionally, the invention provides finger-mounted devices of novel design for use in pairs on stringed musical instruments that can be worn by a musician on the right or left hand while reducing the stress typically imparted to the ligaments, joints and nerves of the string activating hand. The controlled finger movements of a trained musician instantly transfer by kinetic force to the tip of each weighted shaft with a significant increase to the energy imparted at the striking tip.

Other objects and advantages of the invention will be seen when taken into consideration with the following drawings and specification.

DETAILED DESCRIPTION

Figure 1:
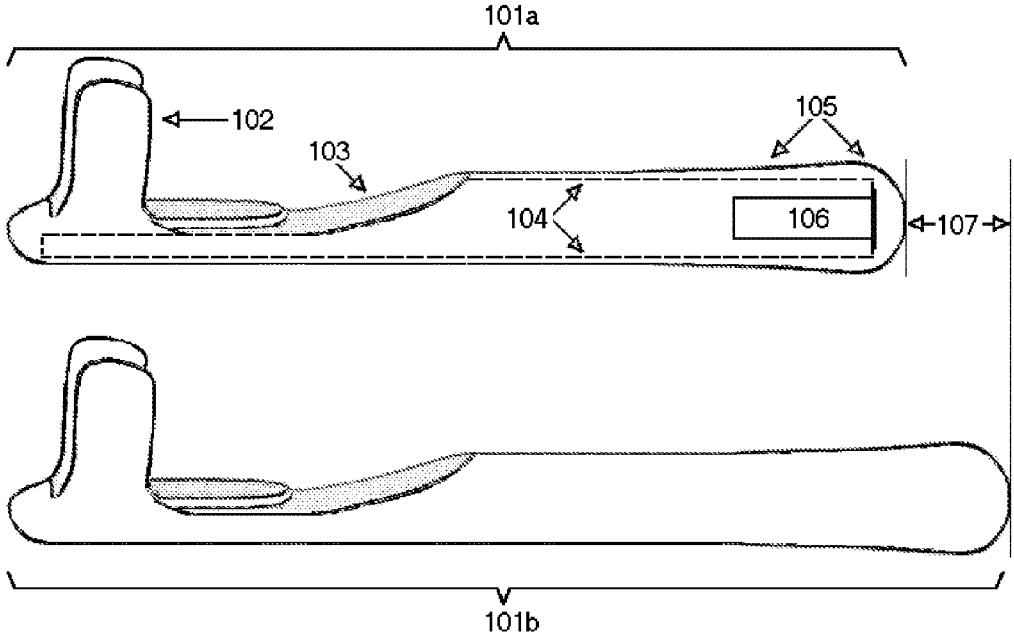
FIG. 1 is an elevational side view of the paired devices that provides details of inferior and exterior construction.

FIG. 1 is an elevational side view of the paired devices 101*a* and 101*b* in accordance with the present invention. The details of construction illustrated by 101*a* indicate the adjustable metal ring 102, upward-sloped fingertip rest 103, elongated cylindrical wooden shaft 104, additional elastomer layers on the shaft at the string striking tip 105, shaft-embedded weight at the string striking tip 108, and the relative difference in length of the paired devices 107.

Figure 2:
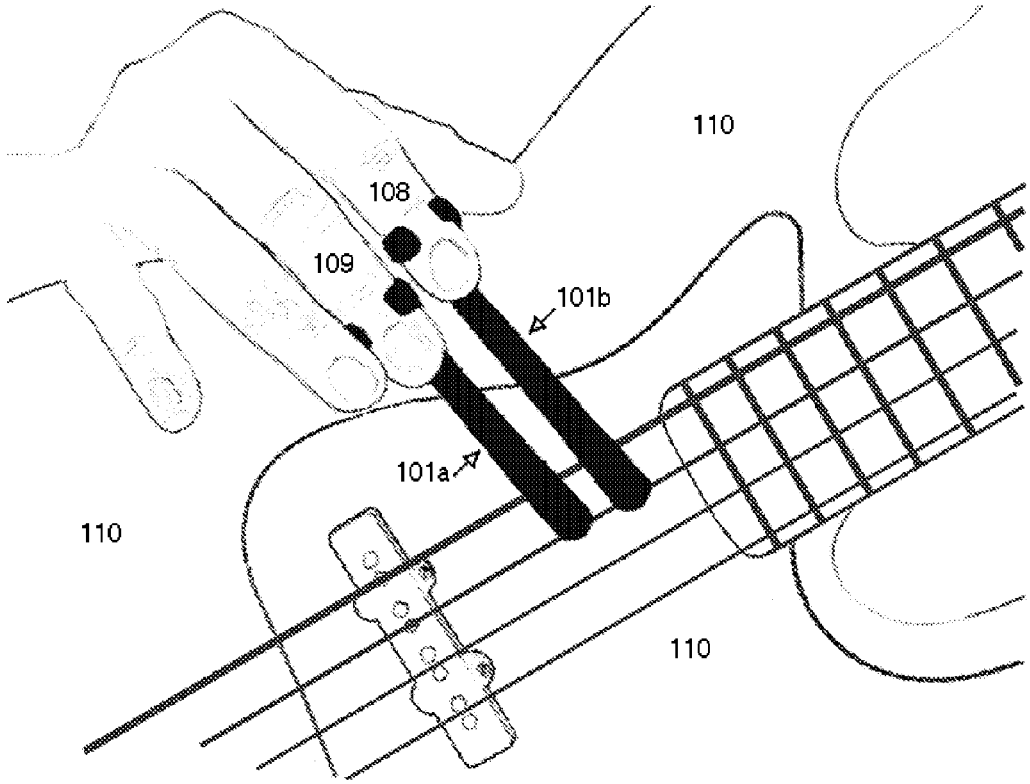
FIG. 2 is a perspective view of the paired finger-mounted striking devices of FIG. 1 with the striking tips in symmetrical contact with the strings of the instrument.

FIG. 2 is a perspective view of the paired devices 101*a* and 101*b* of FIG. 1 correctly positioned on the index 108 and middle 103 fingers of a musician when playing a right-handed electric bass instrument 110.

Figure 3:
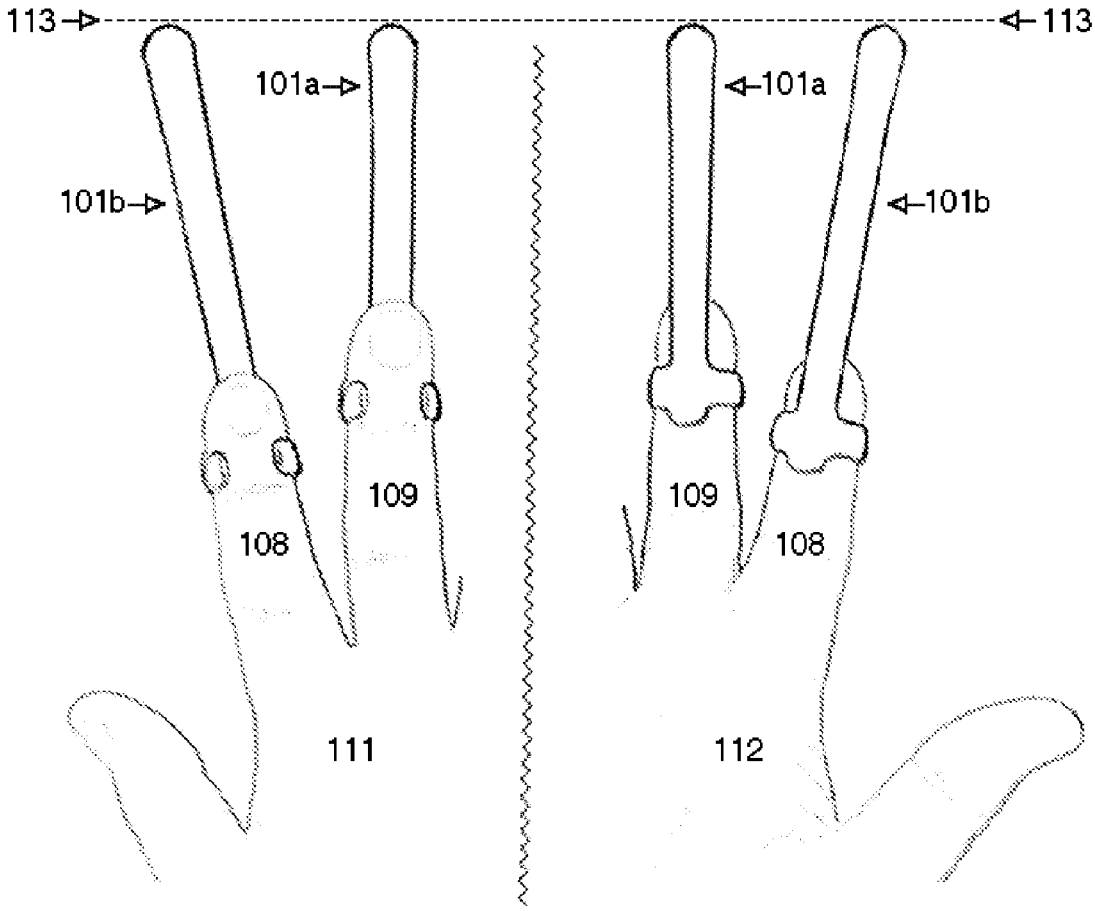
FIG. 3 are perspective views both palmar and dorsal of the paired finger-mounted striking devices illustrating the intended symmetrical length at the striking tip ends.

FIG. 3 are perspective dorsal 111 and palmar 112 views of the paired devices 101*a* and 101*b* of FIG. 1 correctly positioned above the distal interphalangeal joint on the index 108 and middle 109 fingers. As may be seen in FIG. 3, a symmetry in the length of both devices at the striking tip ends 113 is obtained when the paired devices are positioned correctly on the index 108 and middle 109 fingers.

The selection of the particular materials used to construct the shaft body, embedded weight and finger-mounting ring of the paired devices 101*a* and 101*b* of FIG. 1 include any composition known in the art such as, but not limited to, metal and wooden materials. In fact, any alternative materials such as durable plastics or ceramics that provide similar mechanical strength and longevity during repeated use of the finger-mounting ring and string striking tip are considered.

The manufacturing process begins by shaping a string striking shaft body (104), composed of wood, metal, or any appropriate material known in the art. As shown in FIG. 1, the shaft is shaped into an elongated cylindrical shape. Any length or diameter is considered in the present invention, depending upon the comfort or need of the user. However, a preferred elongated length of approximately 10.18 cm and a diameter of 0.9525 cm for paired device 101*a* and a preferred elongated length of approximately 11.43 cm and a diameter of 0.9525 cm for paired device 101*b* has been determined as an optimal proportion for an adult male musician playing a right-handed electric bass instrument using his index and middle finger. When made as a paired device as shown in FIG. 2 and FIG. 3, the individual lengths of the each device will differ, depending upon the position of the ring on the finger and the symmetry at the striking tip ends (113). A portion of each shaft body equal to 3.81 cm in length is removed to a depth of 0.4782 cm to provide a flat surface for installing ring hardware to secure the finger to the device and provide support for the finger when striking the instrument. An upward-slope fingertip rest (103) is then provided with a preferred slope length of 1.27 cm. The determination of the preferred optimal length of the flat surface area and the upward-sloped fingertip rest is to allow an adult male musician playing a right-handed electric bass instrument the option to position the ring at any point along the finger below the distal interphalangeal joint. The string striking tip (105) contains an embedded cylindrical weight with a circumference of 5 mm at the string striking tip (108). A finger-mounting ring (102) composed of metal or any composition known in the art is fixed to the string striking shaft using hot glue, metal rivets, or a combination of both. However any securing means is considered whereby the ring will remain in a fixed position relative to the string striking shaft after repeated, long-term use. The finger-mounting ring (102) can be designed from a mold or modified from most commonly used finger rings. The entire device, including the elongated shaft and attached ring, is coated with an elastomeric material to seal the ring and prevent corrosion. Additional layers of the elastomeric material are then added at the striking tips to reduce wear. Successive dipping of the striking tip into the coating material results in additional applied coatings. A minimum of 5 successive coatings were determined to be required for sustained wear of the striking tip under normal use.

Another embodiment of the present invention considers a Metal Thumb Ring and combined Guitar Pick Holder for use with stringed musical instruments. The Metal Thumb Ring is adjustable for mounting the ring above the distal interphalangeal joint of any thumb. The mechanism inclusive to the Guitar Pick Holder provides guide channels to securely hold standard guitar picks. The available width of Guitar Pick Holder guide channels vary by intention so as to accommodate standard picks that are sized by thickness according to preference for flexibility.

A further embodiment is that the entire structure of the Metal Thumb-Mounting Ring and combined Guitar Pick Holder is encased in an elastomeric coating that prevents scratching of the instrument surface during use and seals the metal ring against corrosion from moisture. The elastomeric coating on the ring also provides additional friction to prevent slippage of the ring from the thumb.

The design of the Guitar Pick Holder mechanism is such that when properly mounted the pick is securely positioned on the palmar side of the thumb. Thus the pick is always accessible for full or intermittent use during performance of musical compositions and cannot be dropped or misplaced. The secured pick can be deployed for string activation by thumb movement alone or by use of the conventional thumb and index finger grip. The fingers of the musician are free at any time to strum or pick the instrument strings with no interference from the guitar pick holder. The Guitar Pick Holder has the further advantage of avoiding the cramps in the palm, thumb, or index finger sometimes experienced with the use of a standard pick. The conventional tight grip, used with a standard pick, is needed to control the rate of string attack and also to prevent dropping the pick during use. The Guitar Pick Holder allows precise control of the pick with very little thumb or index finger pressure, eliminating cramping and preventing muscle or ligament injuries.

Although the present invention has been described with reference to specific embodiments, workers skilled in the art will recognize that many variations may be made there from, it is to be understood and appreciated that the device in accordance with this invention is only one illustration of the many additional potential variations that may be envisioned by one of ordinary skill in the art, and thus are not in any way intended to be limiting of the invention. Accordingly, other objects and advantages of the invention will be apparent to those skilled in the art from the detailed description together with the claims.

I claim:

1. A method for manufacturing a finger-mounted device for rhythmically striking and tapping the strings of a musical instrument, comprising:

a. providing a cylindrical elongated shaft optimized for a length and diameter and having a striking tip and an upward-sloped fingertip rest;

b. affixing a ring to one end of the shaft: where said ring and upward-sloped fingertip rest provide support for securing to a finger;

c. embedding a small-diameter weight in the striking tip of the shaft; and d. coating the device with an elastomeric material.

2. The method of claim 1 further comprising a pair of finger-mounted devices with an offset in respective lengths whereby the striking tips of the paired devices are effectively even in length.

3. The method of claim 2 where the optimum length for the pair of finger-mounted devices are approximately 10.18 cm and 11.43 cm, respectively.

4. The method of claim 1 where the cylindrical elongated shaft is composed of a material from a group consisting of wood, metal, plastic, and ceramic.

5. The method of claim 1 where the cylindrical elongated shaft is wood.

6. The method of claim 1 where a cylindrical weight is embedded into the string striking tip of the cylindrical elongated shaft.

7. The method of claim 1 wherein said affixing is with hot glue, metal rivets, or a combination thereof.

8. The method of claim 1 where said ring is composed of metal.

9. The method of claim 1 where said striking tip is coated with additional layers of the elastomeric material.

10. The method of claim 9 where a minimum of five additional coatings are applied on the striking tip.

* * * * *